US012270624B2

(12) United States Patent
Moretti

(10) Patent No.: US 12,270,624 B2
(45) Date of Patent: Apr. 8, 2025

(54) GUN STOCK WITH ADJUSTABLE COMB

(71) Applicant: BENELLI ARMI S.P.A, Urbino (IT)

(72) Inventor: Luigi Moretti, Collebeato (IT)

(73) Assignee: BENELLI ARMI S.P.A, Pesaro Urbino (IT)

( * ) Notice: Subject to any disclaimer, the term of this patent is extended or adjusted under 35 U.S.C. 154(b) by 23 days.

(21) Appl. No.: 18/483,583

(22) Filed: Oct. 10, 2023

(65) Prior Publication Data

US 2024/0118053 A1 Apr. 11, 2024

(30) Foreign Application Priority Data

Oct. 11, 2022 (IT) ..... 102022000020964

(51) Int. Cl.
*F41C 23/14* (2006.01)
*F41C 23/16* (2006.01)

(52) U.S. Cl.
CPC ..... *F41C 23/14* (2013.01); *F41C 23/16* (2013.01)

(58) Field of Classification Search
CPC ..... F41C 23/14; F41C 23/16
See application file for complete search history.

(56) References Cited

U.S. PATENT DOCUMENTS 1,651,299 A * 11/1927 Stansel ..... F41C 23/14 42/73
3,710,496 A * 1/1973 Packmayr ..... F41C 23/14 42/71.01
4,122,623 A * 10/1978 Stice ..... F41C 23/14 42/73
5,031,348 A * 7/1991 Carey ..... F41C 23/14 42/74
5,235,764 A * 8/1993 Perazzi ..... F41C 23/14 42/73
5,970,642 A * 10/1999 Martin ..... F41C 23/00 42/74
8,429,844 B2 * 4/2013 Dextraze ..... F41A 9/71 42/73
8,453,365 B1 * 6/2013 Ballard ..... F41C 23/14 42/74
8,984,790 B2 3/2015 Wilson et al.
D831,149 S * 10/2018 Barfoot ..... D22/108
10,317,165 B2 * 6/2019 Saltzman ..... F41C 23/06
(Continued)

FOREIGN PATENT DOCUMENTS

DE 102006059914 7/2007
DE 202009017766 9/2010
(Continued)

*Primary Examiner* — Michelle Clement
(74) *Attorney, Agent, or Firm* — DUANE MORRIS LLP; Gregory M. Lefkowitz

(57) ABSTRACT

Gun stock with adjustable comb includes a stock body having an adjustable comb which comprises a cheek rest member associated to a supporting structure associated to the stock body; the supporting structure has a hollow guide body slidable along a pin associated to the stock body; the guide body is slidable with respect to the pin in contrast to an elastic member; the guide body is engaged by a drive means that has a button accessible from the outside of the stock body; the height of the comb with respect to the stock body is adjusted by acting on the button for the engagement and disengagement of the guide body with respect to the pin integral with the stock body.

12 Claims, 18 Drawing Sheets

(56) References Cited

U.S. PATENT DOCUMENTS

| | | | | |
|---|---|---|---|---|
| 10,458,746 | B2 | 10/2019 | Frazier et al. | |
| 10,830,559 | B2 | 11/2020 | Rothärmel | |
| 10,866,060 | B2 | 12/2020 | Inneci | |
| 2007/0056202 | A1 | 3/2007 | Oz | |
| 2008/0236016 | A1* | 10/2008 | Fitzpatrick | F41C 23/14 42/71.01 |
| 2020/0355462 | A1 | 11/2020 | Inneci | |
| 2021/0048274 | A1 | 2/2021 | Hopkins et al. | |
| 2021/0063111 | A1 | 3/2021 | Haugen | |

FOREIGN PATENT DOCUMENTS

| | | |
|---|---|---|
| EP | 3163248 | 5/2017 |
| RU | 2546757 | 4/2015 |
| TR | 2015/11508 U | 2/2016 |
| TW | M410210 U | 10/2010 |

* cited by examiner

GUN STOCK WITH ADJUSTABLE COMB

The present invention relates to a gun stock with an adjustable comb.

As is known, the comb of a firearm, in particular of a gun, such as a shotgun or rifle, is the upper part of the stock extending from the grip to the part where the cheekbone rests.

Different types of adjustable combs are known.

DE202009017766U1, TWM410210U, U.S. Pat. Nos. 737,732A, 8,984,790B2, 10,458,746B2, and 10,866,060B2, disclose adjustable combs; EP1748272A2, U.S. Pat. No. 8,453,365B1, and WO2019190439A2 disclose stocks having a telescopic comb; TR201511508U discloses an adjustable comb for air guns; U.S. Pat. No. 10,830,559B2 discloses a positioning device of stock members.

In general, the position of the comb, or cheek rest, is adjusted and fastened using tools, however such an operation is complex and time consuming.

In certain situations, for example in unpredictable hunting conditions, a quick and simple adjustment operation of the cheek rest is desirable, and simplified adjustment systems have therefore been proposed.

The aim of the present invention is to provide a gun stock with an adjustable comb, wherein the comb or cheek rest is adjustable in an improved manner with respect to the prior art.

Within the scope of this aim, an object of the invention is to provide a gun stock wherein the comb or cheek rest is adjustable by means of a structure integrated in the stock.

An important object of the invention is to provide a gun stock with an adjustable comb that can be manufactured at a lower cost with respect to prior art systems.

A further object of the present invention is to provide a gun stock with an adjustable comb that, due to its particular constructive characteristics, is capable of ensuring the greatest guarantees of reliability and safety in use.

These objects and others which will better appear hereafter, are achieved by a gun stock with an adjustable comb as claimed in the appended claims.

Further characteristics and advantages will become clearer from the description of preferred, but not exclusive, embodiments of the invention, illustrated by way of indicative and non-limiting purposes in the attached drawings, in which.

Figure 1:
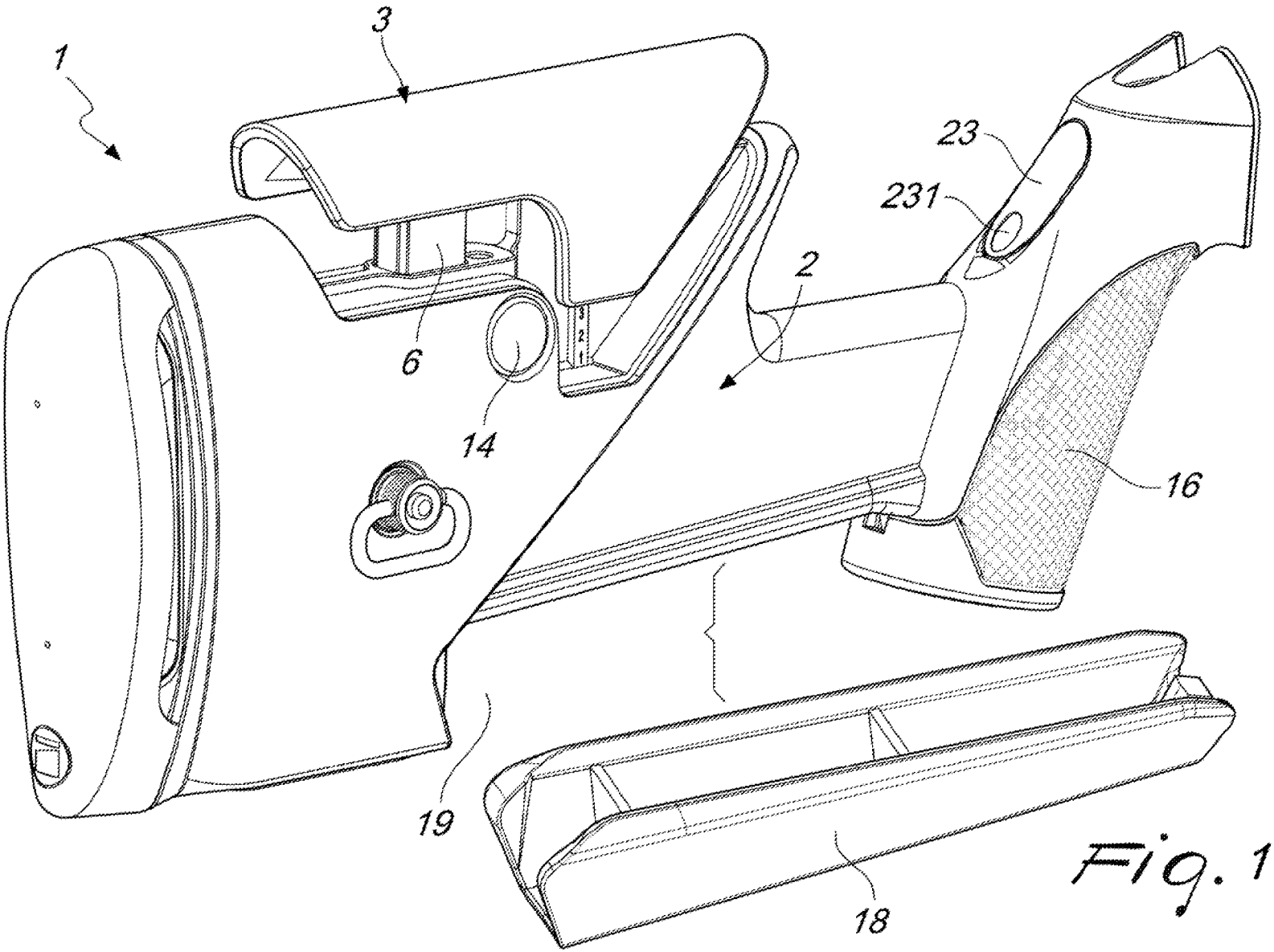
FIG. 1 is a perspective view of a stock provided with the adjustable comb according to the present invention.

With reference to the cited figures, the gun stock with adjustable comb, according to the invention, globally identified by the reference number 1, comprises a stock body 2 provided with an adjustable comb 3.

The comb 3 comprises a cheek rest member 4 which, by means of a locking screw 61, is associated to a supporting structure 5 in turn associated to the stock body 2.

The supporting structure 5 comprises a hollow guide body 6, slidable on a pin 7 which is made integral with the stock body 2.

The guide body 6 is slidable with respect to the pin 7 in contrast with a drive spring 8, coaxial to the pin 7.

The guide body 6 comprises a set of teeth 9 configured to be engaged by a stop pin 10 by means of lugs 11.

The stop pin 10 is hollow and contains a limit member 12 coaxial to a contrast spring 13.

The stop pin 10 comprises a button 14 accessible from the outside of the stock body 2.

The stop pin 10 further comprises a groove 110 adapted to receive a pin 111.

Figure 11:
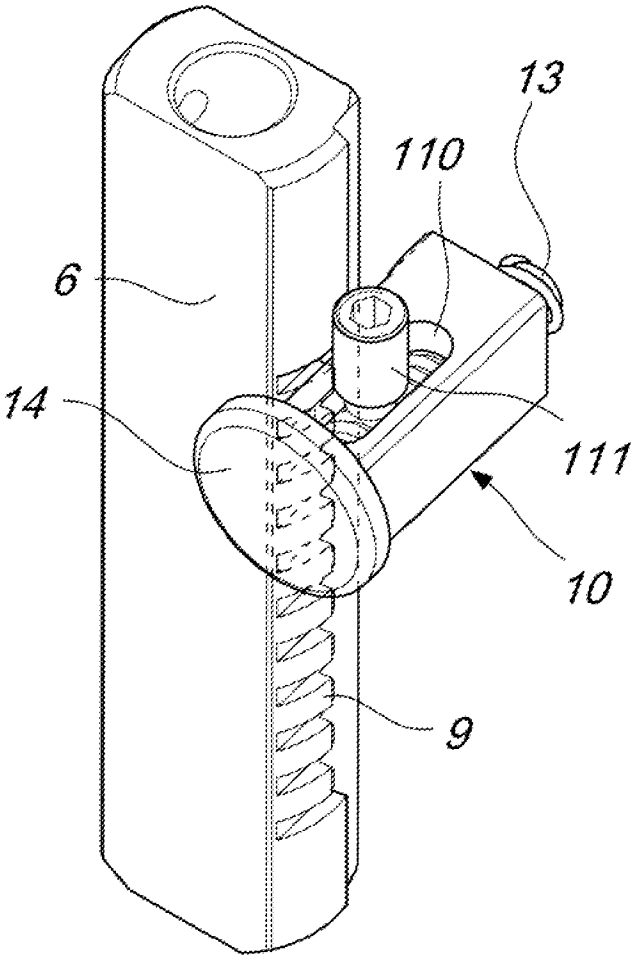
FIG. 11 is a perspective view of the stop system showing the comb stop pin pressed.
Figure 10:
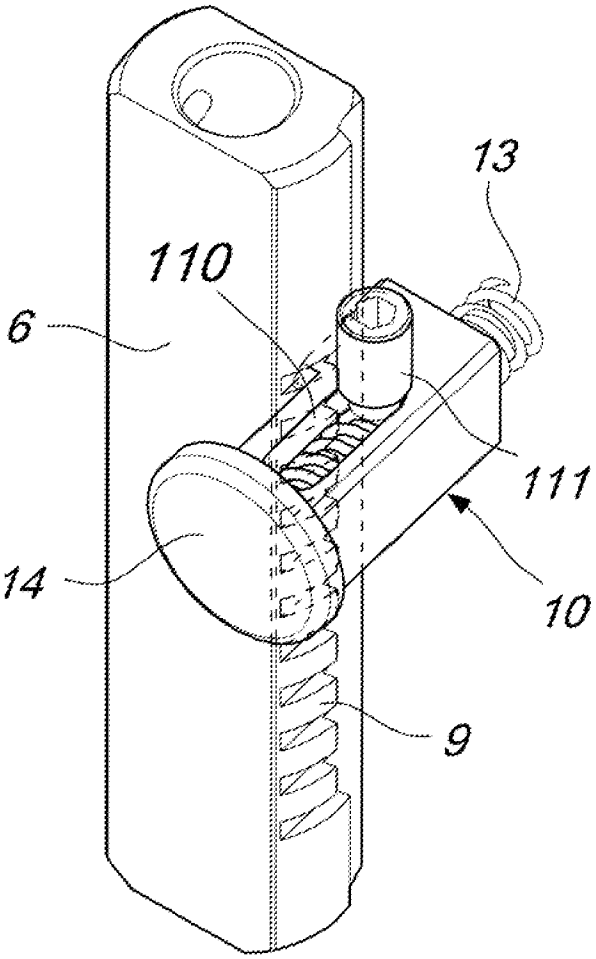
FIG. 10 is a perspective view of the stop system showing the comb stop pin engaged.

The height of the comb 4 is adjusted by pressing the button 14 of the stop pin 10 which disengages the teeth 9 of the guide body 6, from the locking position, visible in FIG. 10, to the free position, visible in FIG. 11, thus allowing the guide body 6, and thus the comb 4, to raise or lower into the desired position, in contrast with the action of the drive spring 8 and the pin 7.

The adjustable comb structure according to the invention allows such an adjustment to be made with just one hand since, by pressing the button 14, the drive spring 8 is allowed to force the component upwards.

The user's cheek can be positioned on the comb 4 as it is moved until it reaches the desired height.

At this point, by releasing the button 14, the decompression of the contrast spring 13 allows the lugs 11 of the stop pin 10 to be positioned between the teeth 9 of the guide body 6, thus preventing any vertical movement.

The system according to the invention allows a very rapid adjustment of the comb 4 without the need to use tools, and further allows it to be adjusted in different positions, each of which is marked on the stock.

To avoid improper disassembly during the height adjustment of the comb, the stop pin 10 is provided with the limit member 12, positioned inside the spring 13, which increases the switching load only during the disassembly step of the comb and not during adjustment.

Figure 12:
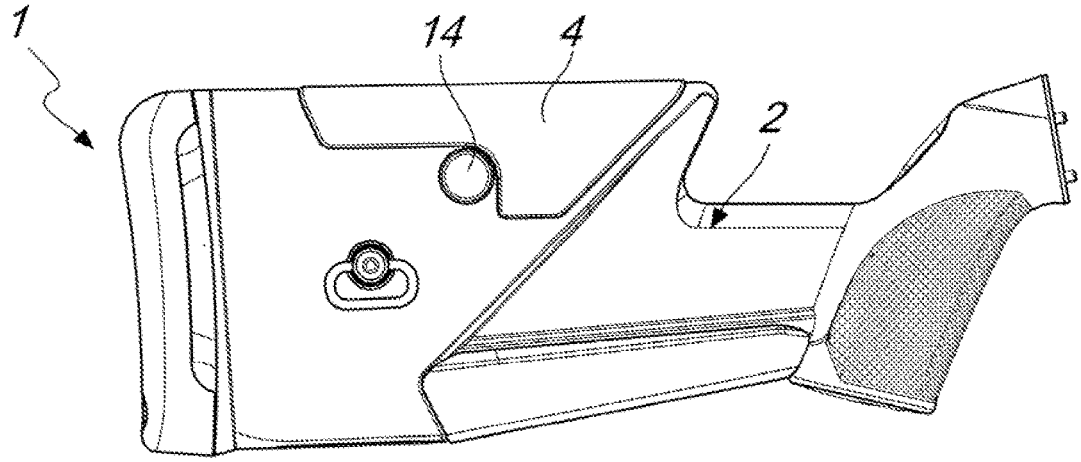
FIG. 12 is a side view of the stock showing the comb in the low position.
Figure 13:
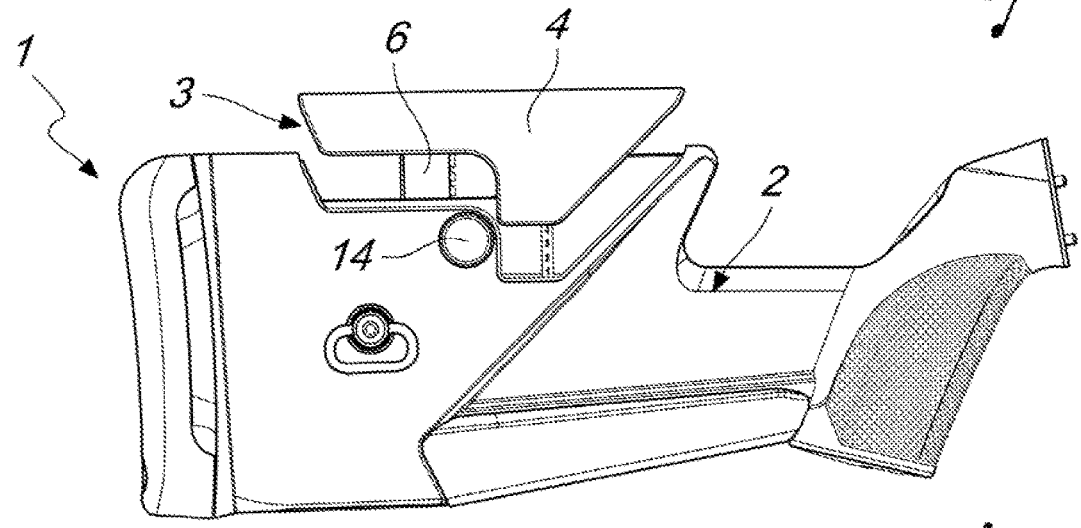
FIG. 13 is a side view of the stock showing the comb in the intermediate position.
Figure 14:
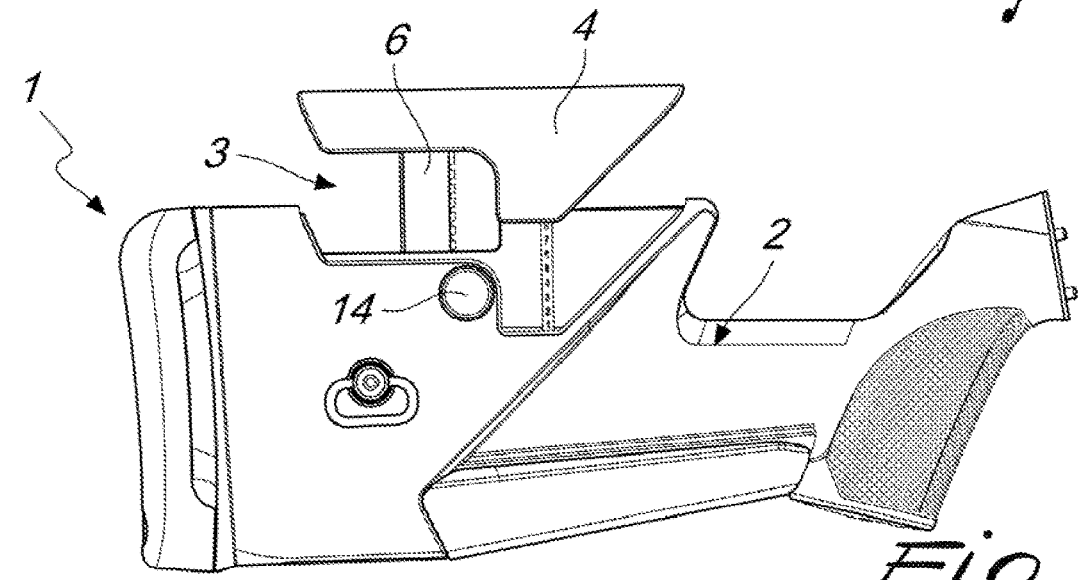
FIG. 14 is a side view of the stock showing the comb in the high position.

FIGS. 12-14 show three comb positioning examples, respectively in a low position, in an intermediate position, and in a high position.

The stock 1 comprises an interchangeable grip, identified by the reference number 16.

Figure 15:
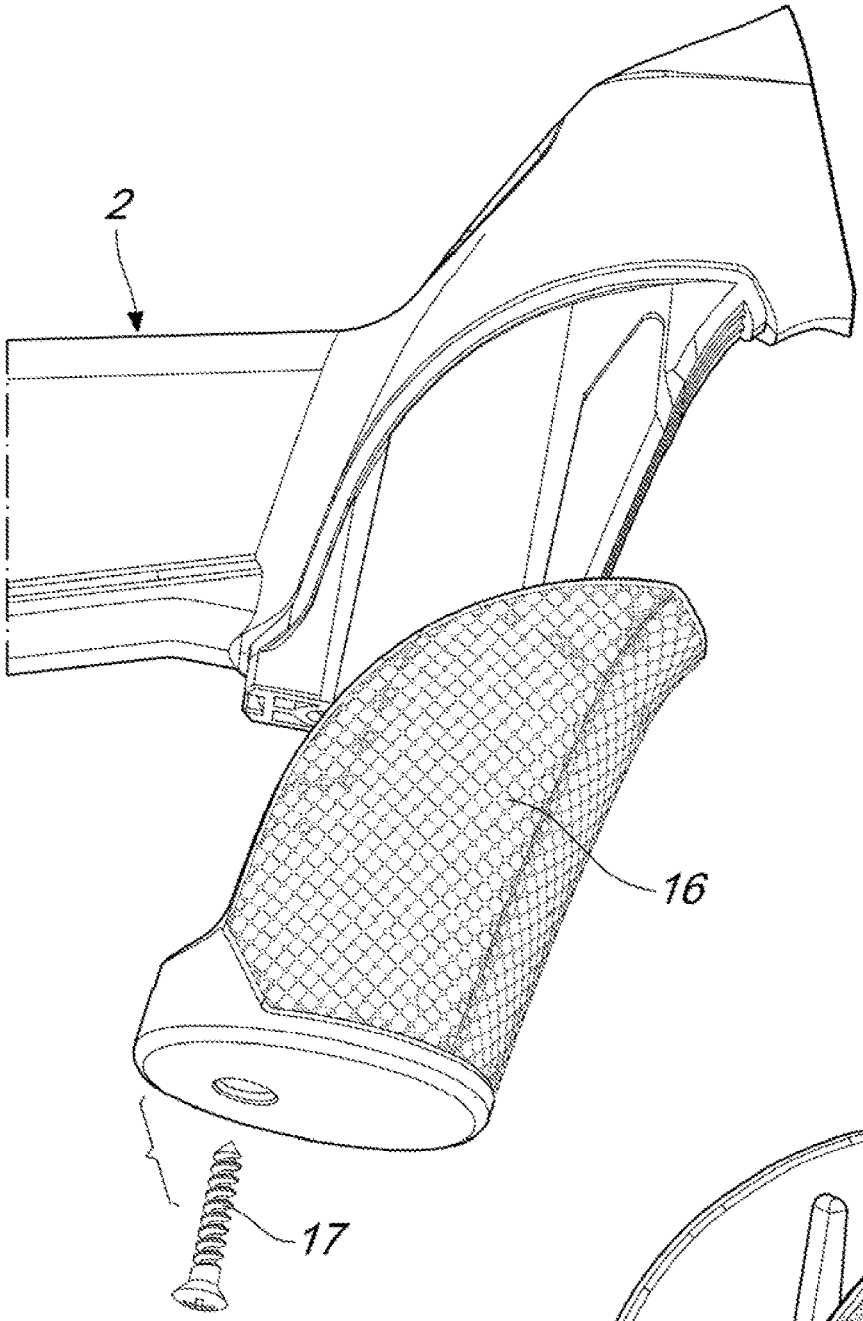
FIG. 15 is a partial perspective view illustrating the grip fastening system.
Figure 16:
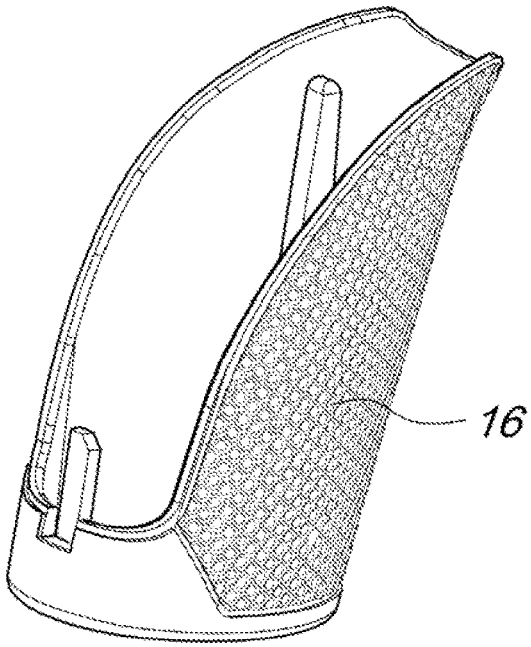
FIG. 16 is a perspective view of the grip.

The ergonomics of the grip can be modified, offering interchangeable grips fastened to the stock by means of a screw 17 on the lower side of the grip itself, as shown in FIGS. 15 and 16.

This allows the user to vary the inclination of the grip and thus the hand position to better suit their shooting style or discipline.

Figure 17:
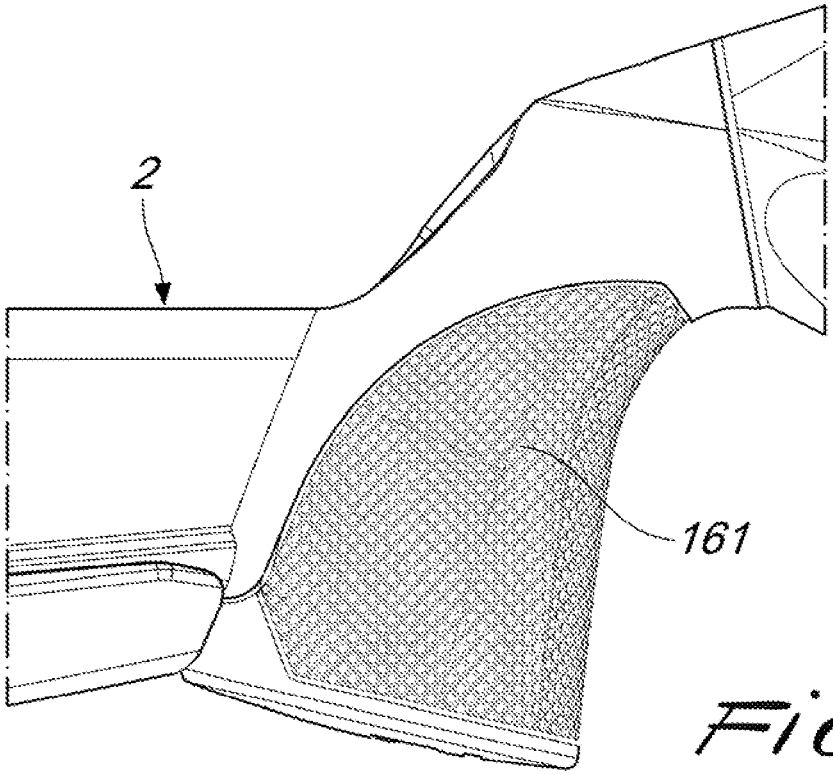
FIG. 17 is a partial perspective view illustrating the stock showing a less inclined grip.
Figure 18:
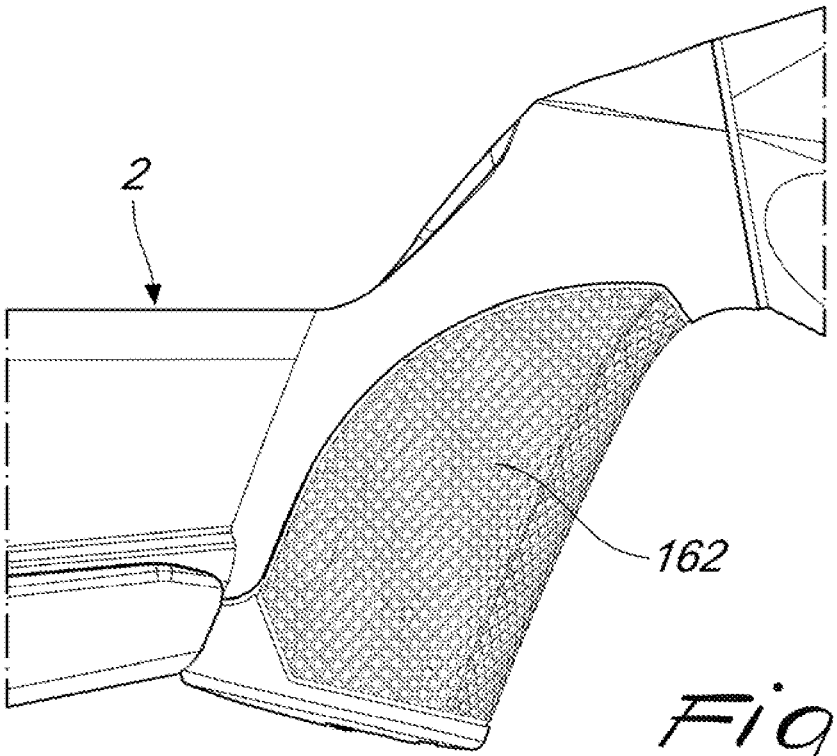
FIG. 18 is a partial perspective view illustrating the stock showing a more inclined grip.

FIGS. 17 and 18 show different configurations of the grip, respectively a more inclined grip 161 and a less inclined grip 162.

Figure 19:
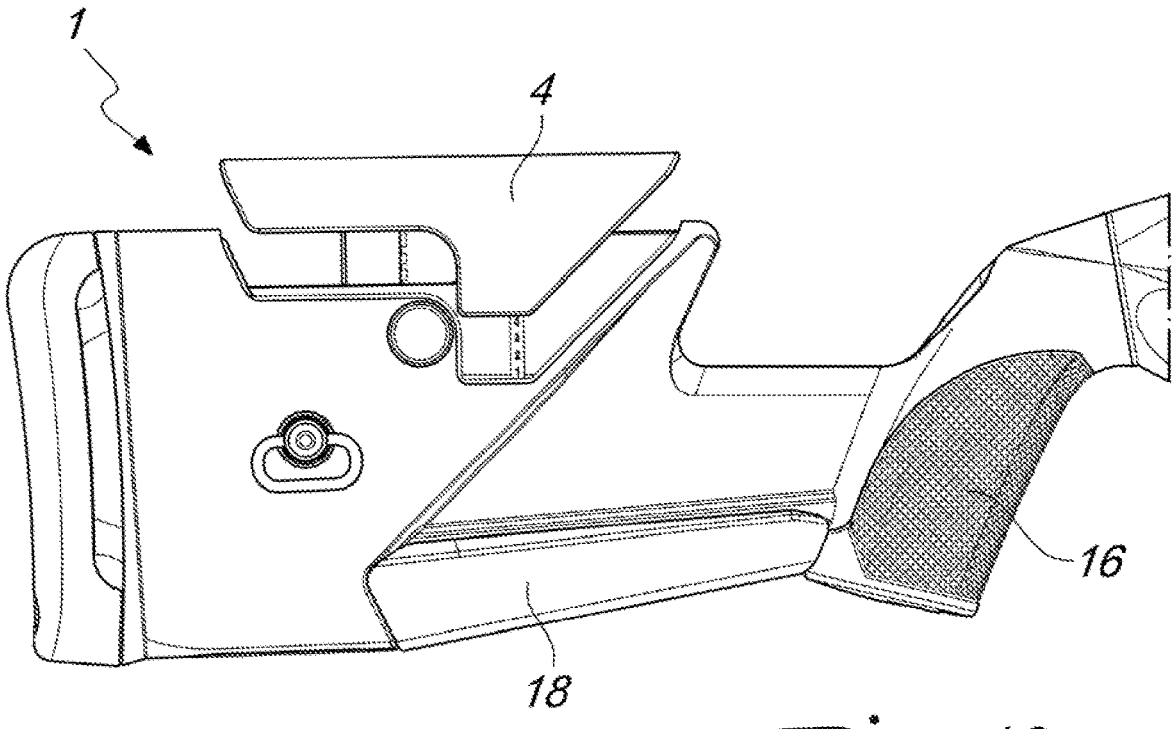
FIG. 19 is a side view of the stock showing the bag rider installed.
Figure 21:
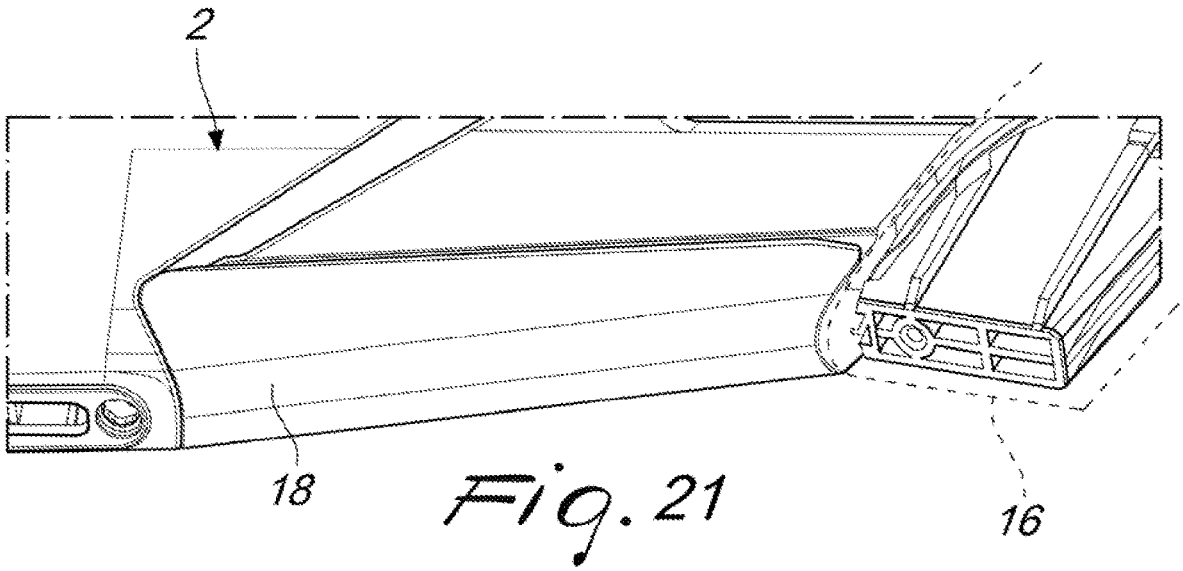
FIG. 21 is a partial perspective view illustrating the stock showing the bag rider partially installed.

The stock 1 further comprises a detachable bag rider 18, as visible in FIGS. 19 and 21.

Figure 20:
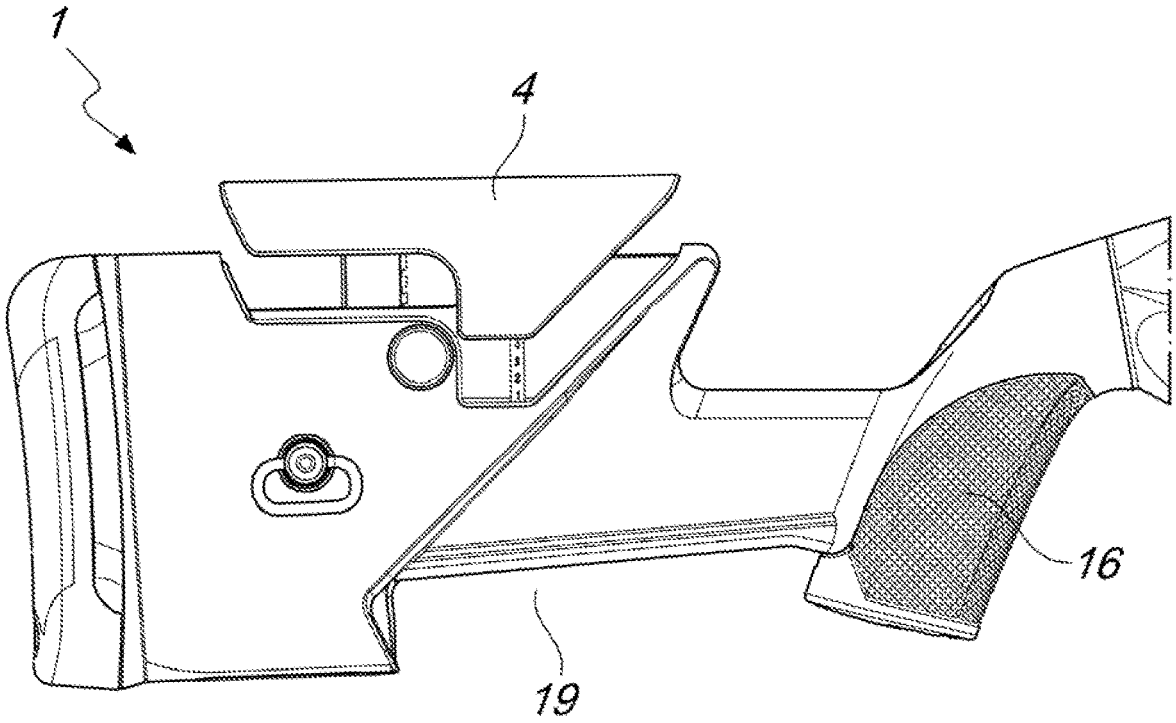
FIG. 20 is a side view of the stock without the bag rider.

The bag rider 18 can be removed to expose a recess 19 of the stock body 2, as shown in FIG. 20.

The detachable bag rider 18 contributes to the modularity of the stock according to the invention, allowing it to meet to the different needs of the users who can configure the weapon according to their shooting styles and preferences.

The recess 19 of the stock, without bag rider 18, called "palm hook", is used by many shooters to push, with the hand not used to shoot, the rear part of the weapon towards the shooter's shoulder.

The recess 19 of the stock carries out a further function, i.e., that of allowing the locking in position of the bag rider 18 and thus its fastening to the stock body 2, simply by mounting the interchangeable grip 16.

FIG. 21 shows the bag rider 18 arranged in the stock body 2 before the grip 16 is fastened.

Figure 22:
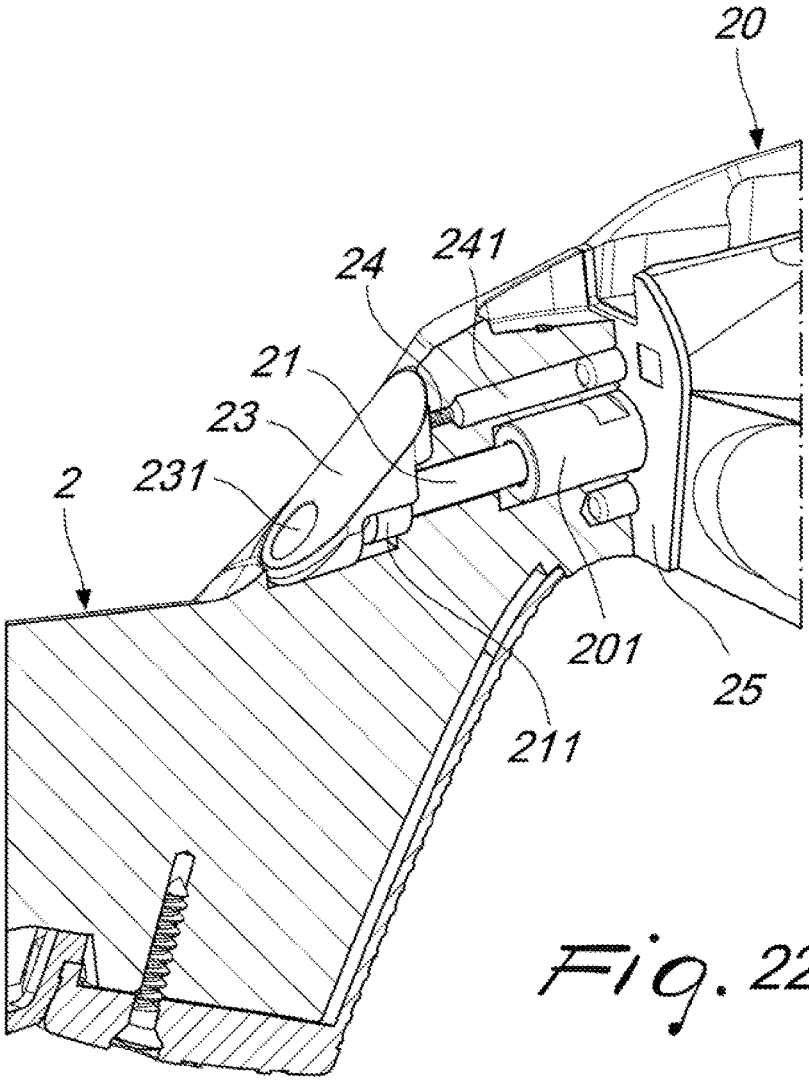
FIG. 22 is a partial perspective view, in cross-section, illustrating the stock fastening and lid retaining system.

FIG. 22 shows the fastening system of the stock body 2 to the receiver 20 of the weapon.

The stock fastening system comprises a screw 21 passing through a recess 22 formed in the stock body 2 and covered by a lid 23.

The lid 23 has an aesthetic function and allows the user to access the head 211 of the screw 21 by means of a tool, through a small hole 231 of the lid 23.

The lid 23 is fastened to the stock body 2 by means of a retaining screw 24, accessible through a hole 241 on the opposite side, so as to avoid any clearance and risk of the lid itself falling.

With the stock removed, this system prevents the screw 21 from falling and thus prevents the unintentional loss of useful parts for subsequent assembly.

The stock 1 further comprises a drop and cast adjustment system.

Figure 23:
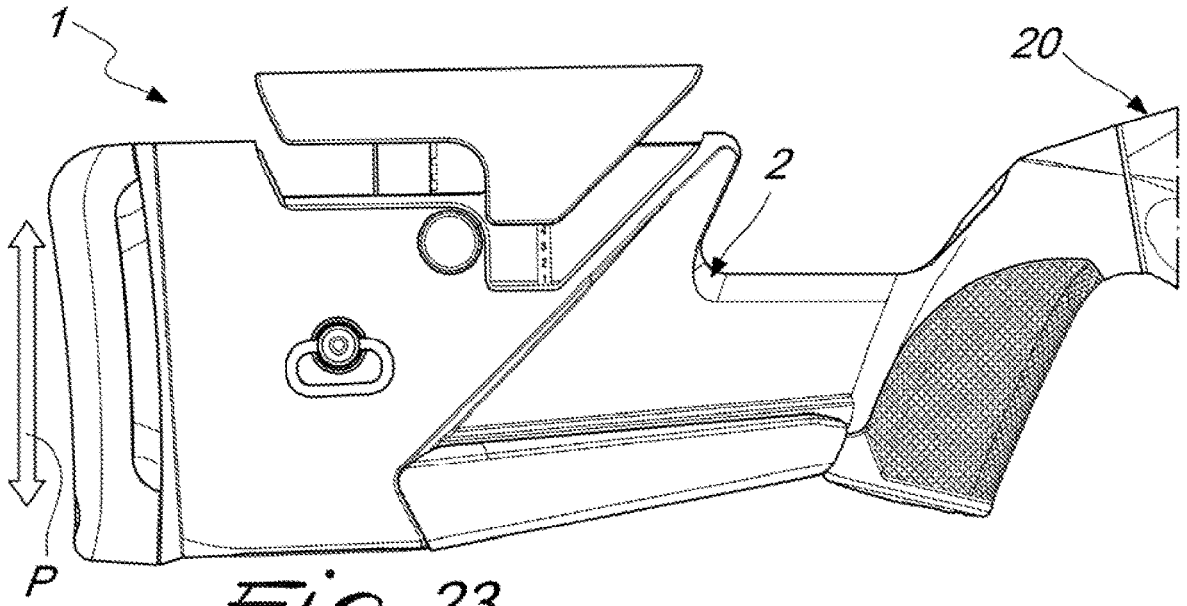
FIG. 23 is a side view illustrating the variation of the stock drop.
Figure 24:
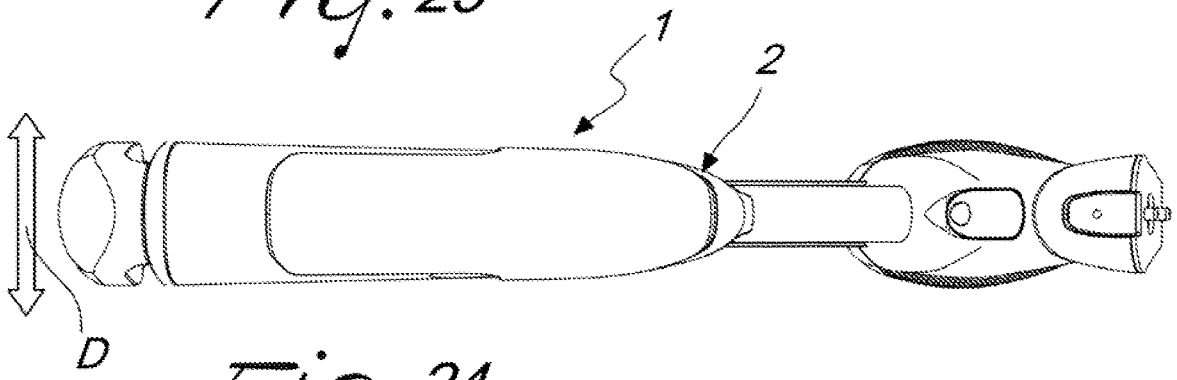
FIG. 24 is a plan view illustrating the variation of the stock cast.
Figure 25:
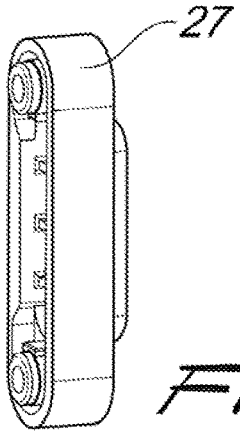
FIG. 25 is a perspective view of the movable spacer of the buttplate.
Figure 26:
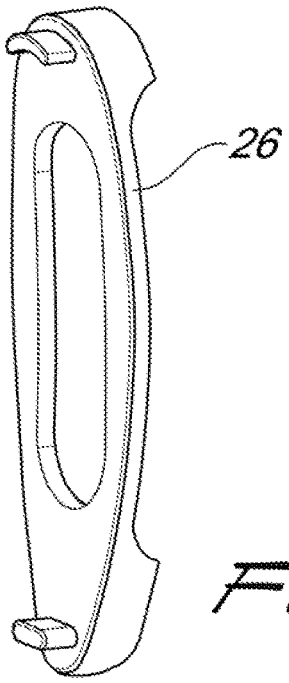
FIG. 26 is a perspective view of the fixed spacer of the buttplate.
Figure 27:
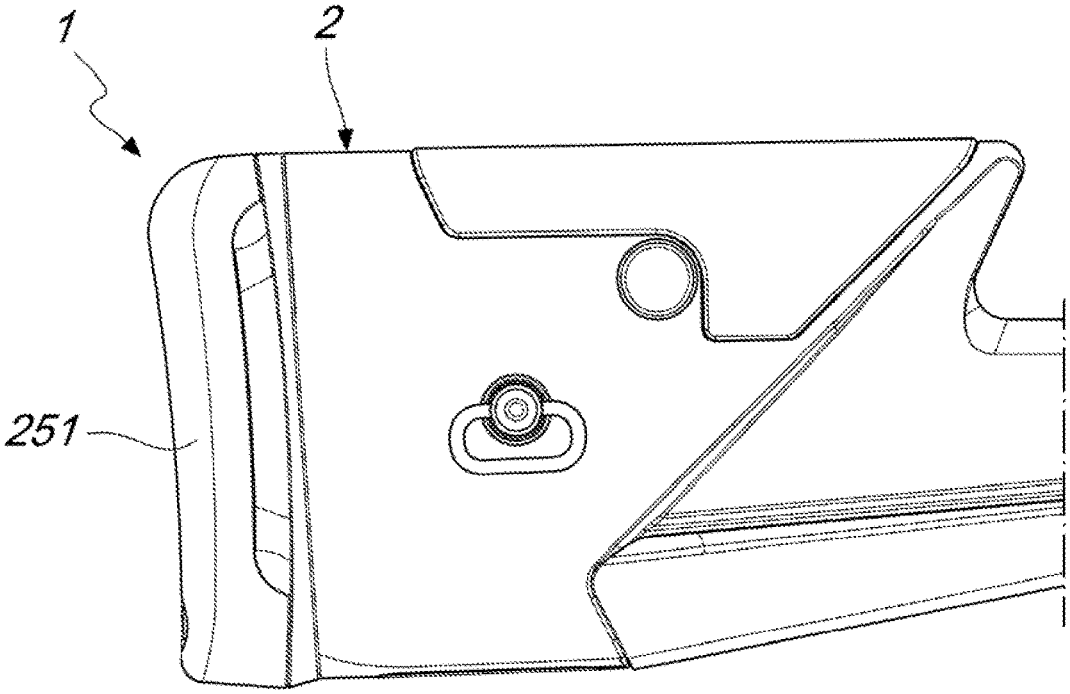
FIG. 27 is a partial side view illustrating the stock with standard buttplate.
Figure 28:
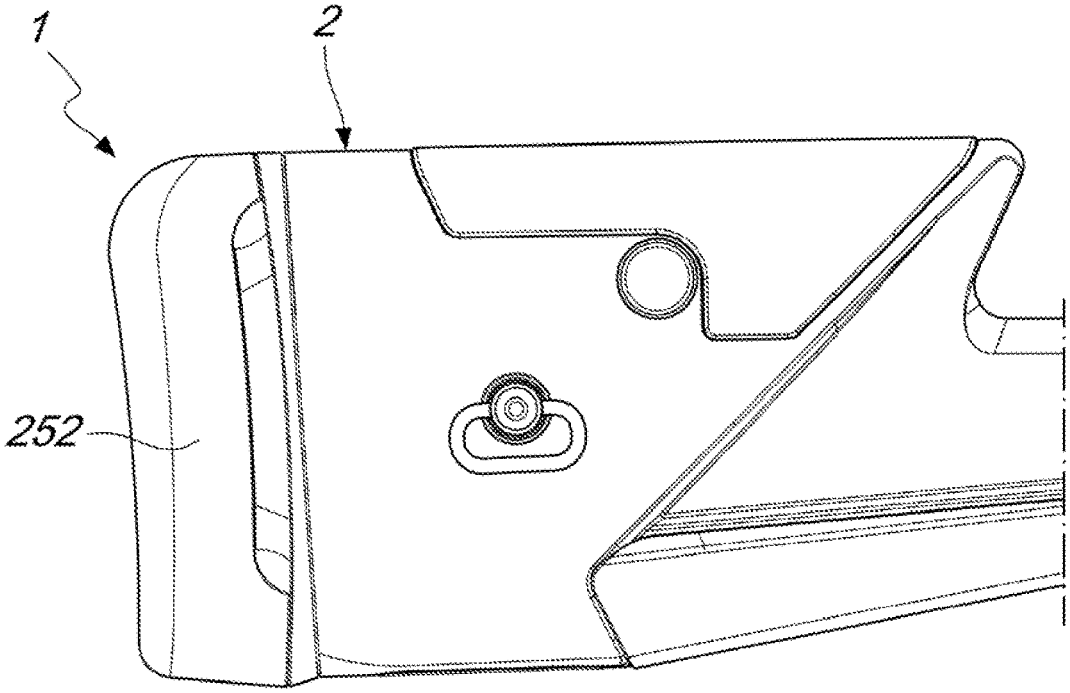
FIG. 28 is a partial side view illustrating the stock with high buttplate.

The system for fastening the stock 1 to the receiver 20 allows to easily modify both the drop P, as indicated in FIG. 23, and the cast D, as indicated in FIG. 24, of the stock 1, by replacing a plate 25, visible in FIG. 22, interposed between the stock body 2 and the receiver 20, with another plate having a different geometry/inclination.

The receiver 20 comprises a thread reducer 201 fastened to the receiver itself.

The stock 1 further comprises a system for adjusting the length of pull (LOP), i.e. the distance between the buttplate and the trigger of the weapon, of the type described in U.S. Ser. No. 11/035,644B2, in the name of this same applicant.

The LOP adjustment system, illustrated in FIGS. 25-37, comprises buttplates of different thicknesses, identified by the reference numbers 251 and 252.

Figure 2:
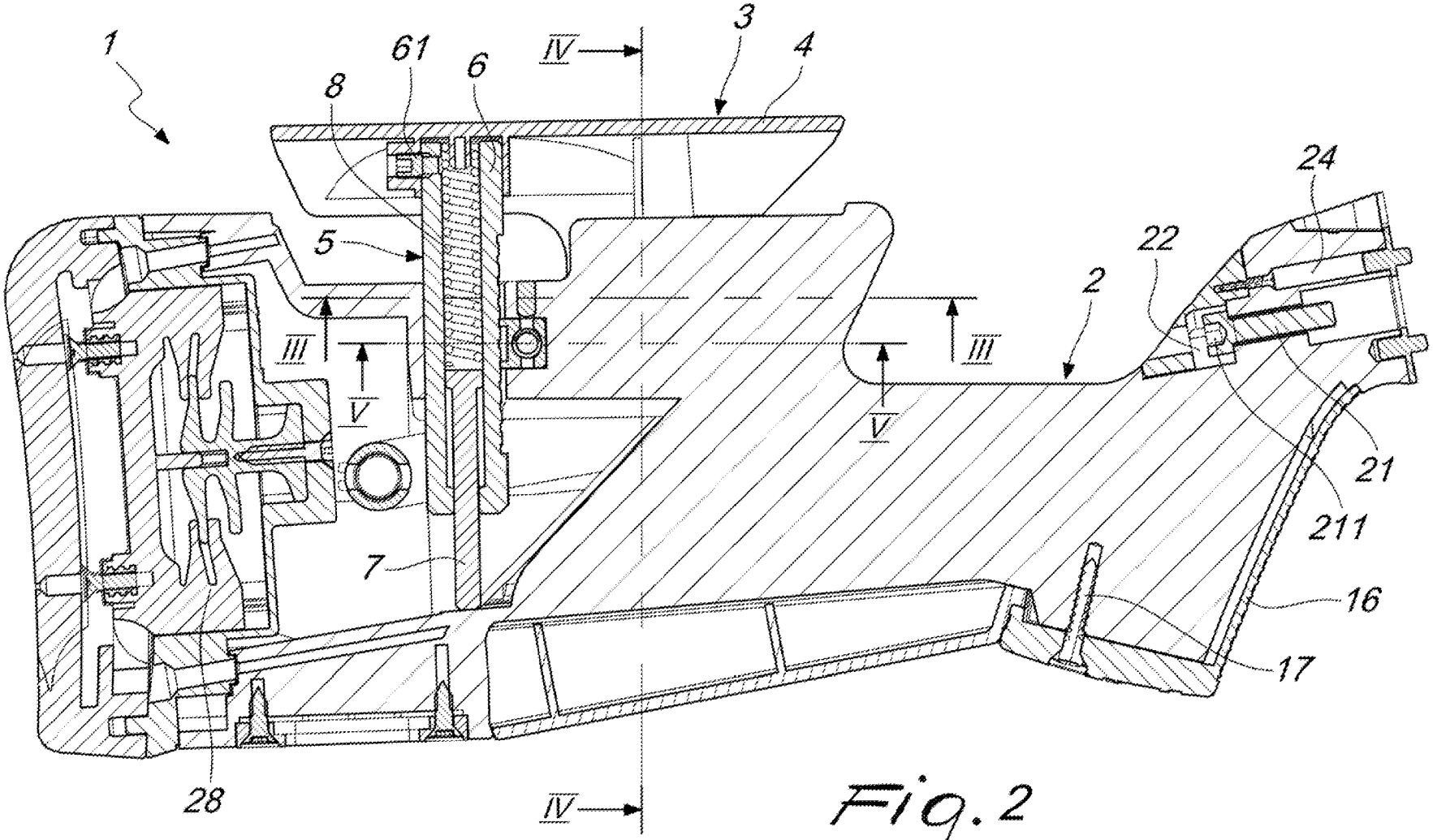
FIG. 2 is a sectional view of the stock of the previous figure.
Figure 3:
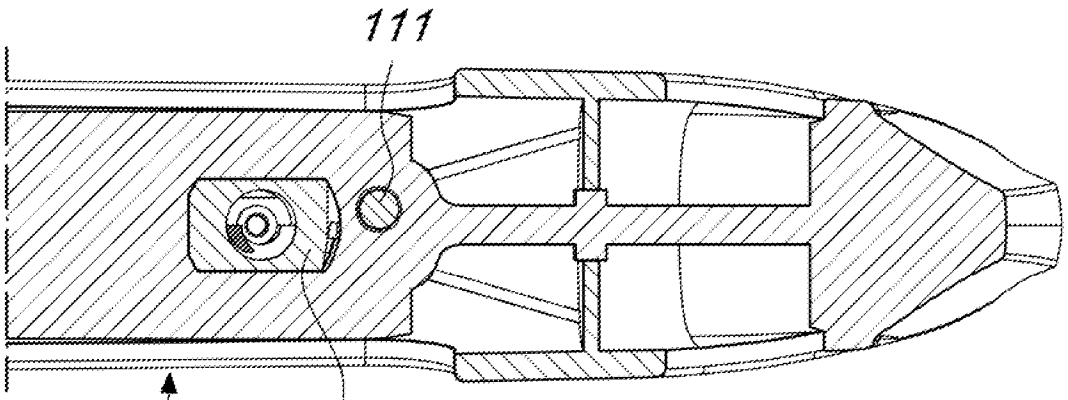
FIG. 3 is a sectional view according to the section plane III of FIG. 2.
Figure 5:
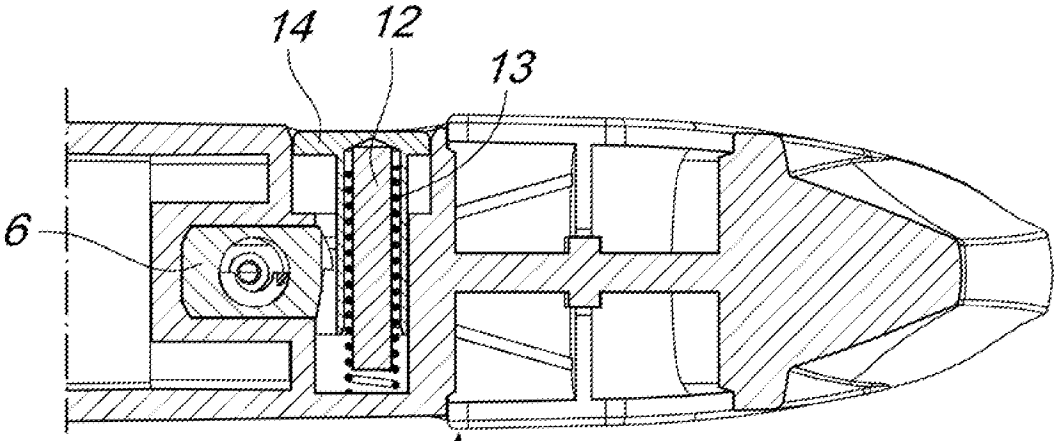
FIG. 5 is a sectional view according to the section plane V of FIG. 2.
Figure 4:
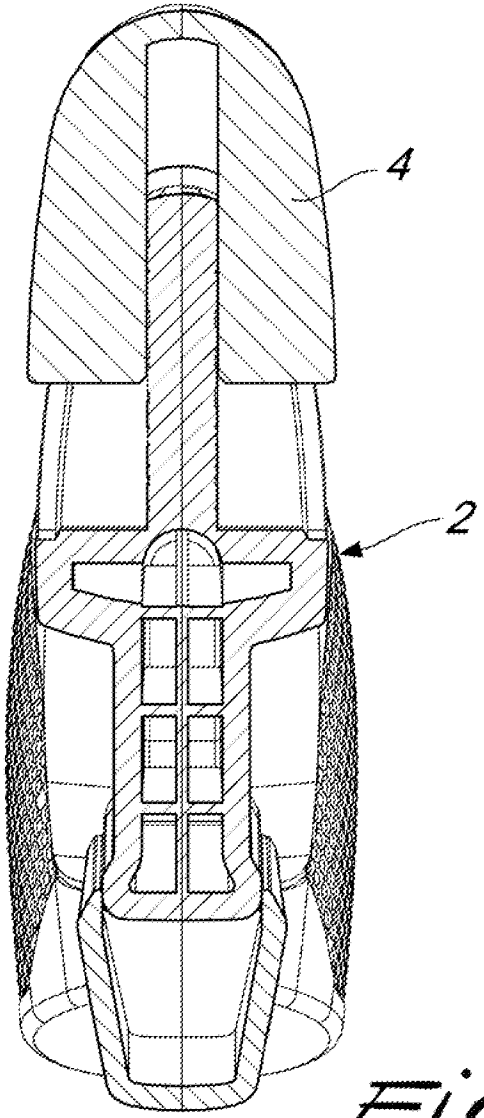
FIG. 4 is a sectional view according to the section plane IV of FIG. 2.
Figure 6:
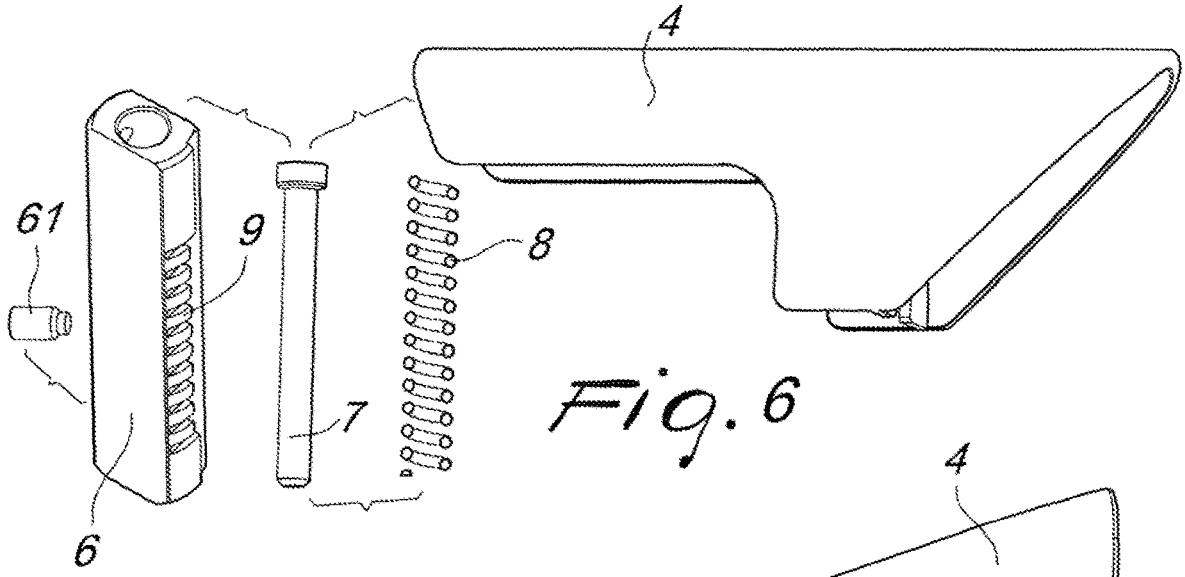
FIG. 6 is a perspective view illustrating the components of the comb assembly.
Figure 7:
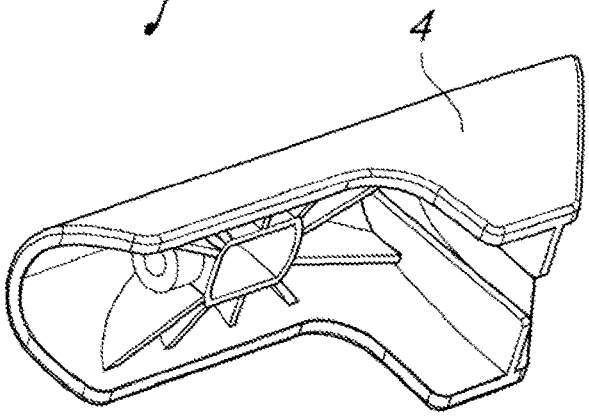
FIG. 7 is a perspective view of the bottom of the comb.
Figure 8:
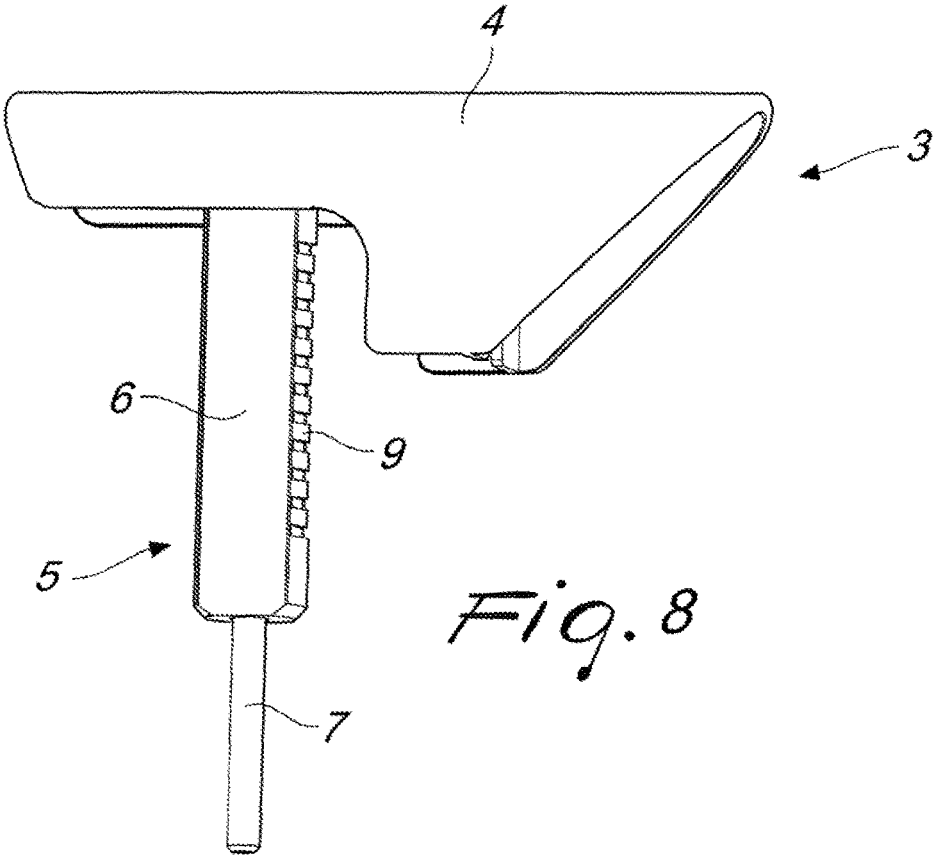
FIG. 8 is a side view of the comb assembly.
Figure 9:
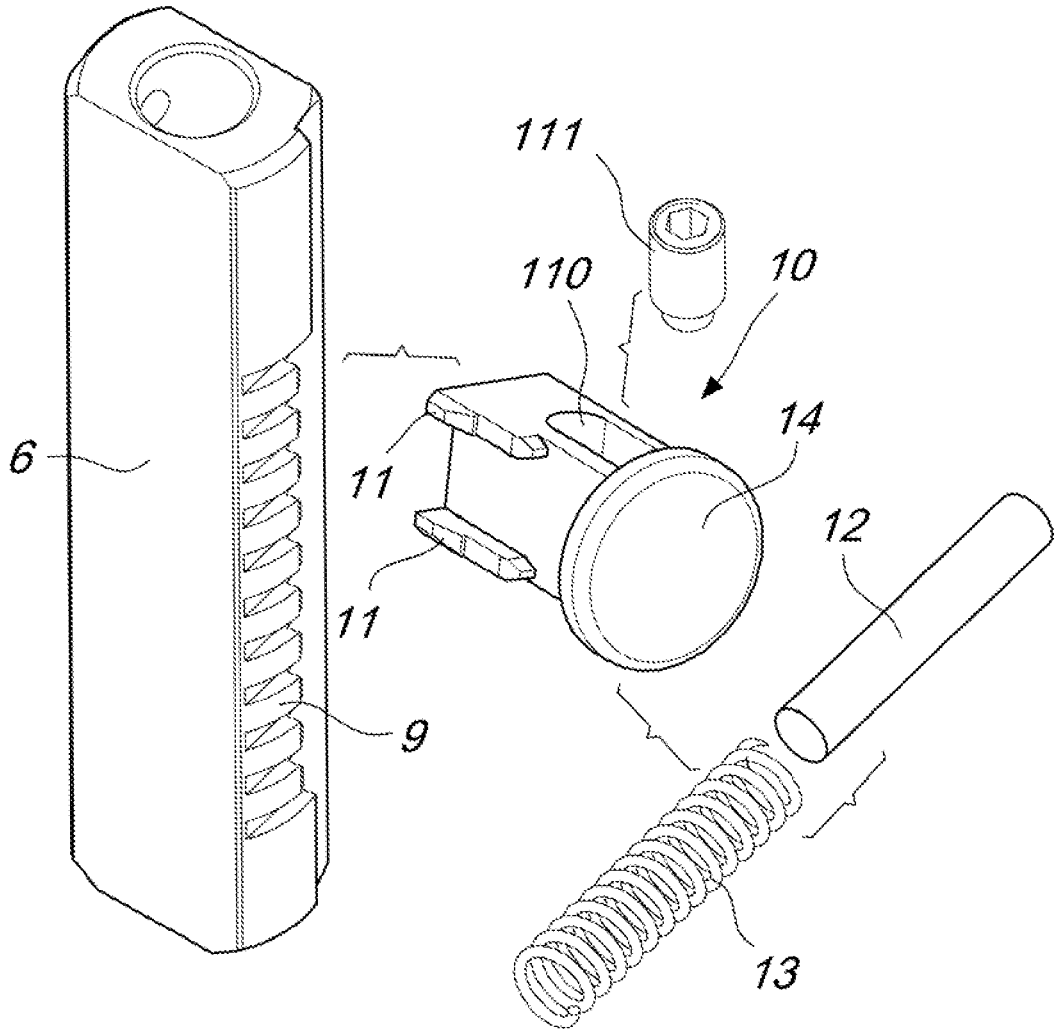
FIG. 9 is an exploded perspective view of the comb stop system.

Furthermore, the system comprises pairs of spacers comprising a fixed spacer 26 and a movable spacer 27, adapted to operate with a recoil pad device, identified by the reference numeral 28 and visible in FIG. 2, of the type described in patent EP2711660B1, in the name of this same applicant.

The spacers have been designed so that the fixed spacer 26 is integral with the stock body 2, while, during firing, the movable spacer 27 allows the movable unit of the recoil pad system to freely slide with respect to the stock body 2.

The user can use various combinations of the above components to achieve the desired configuration.

Figure 29:
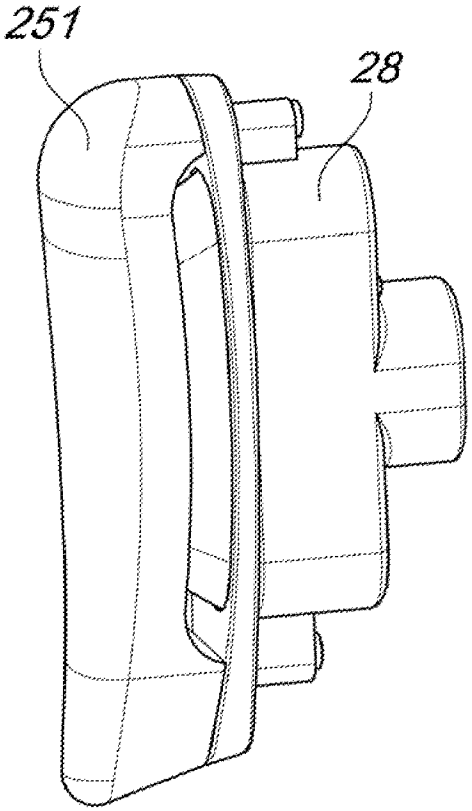
FIG. 29 is a perspective view of a comfort buttplate without spacers.
Figure 32:
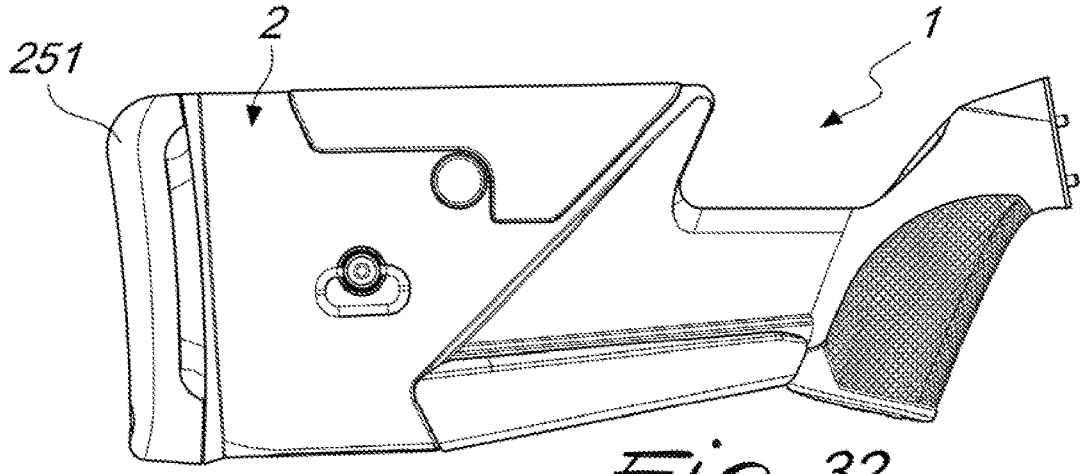
FIGS. 32-37 are side views of the stock illustrating various examples of configurations made by combining buttplates and spacers.
Figure 33:
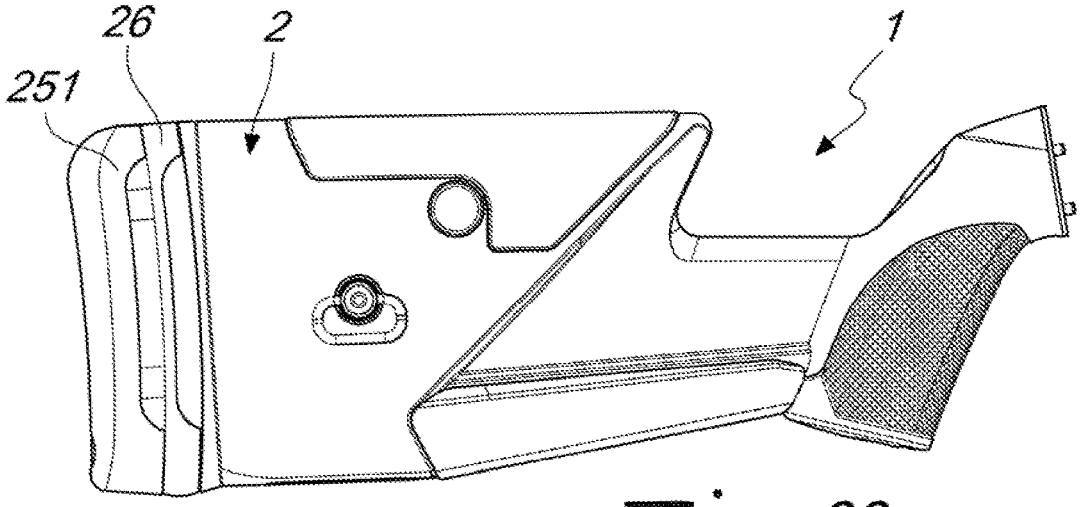
Figure 34:
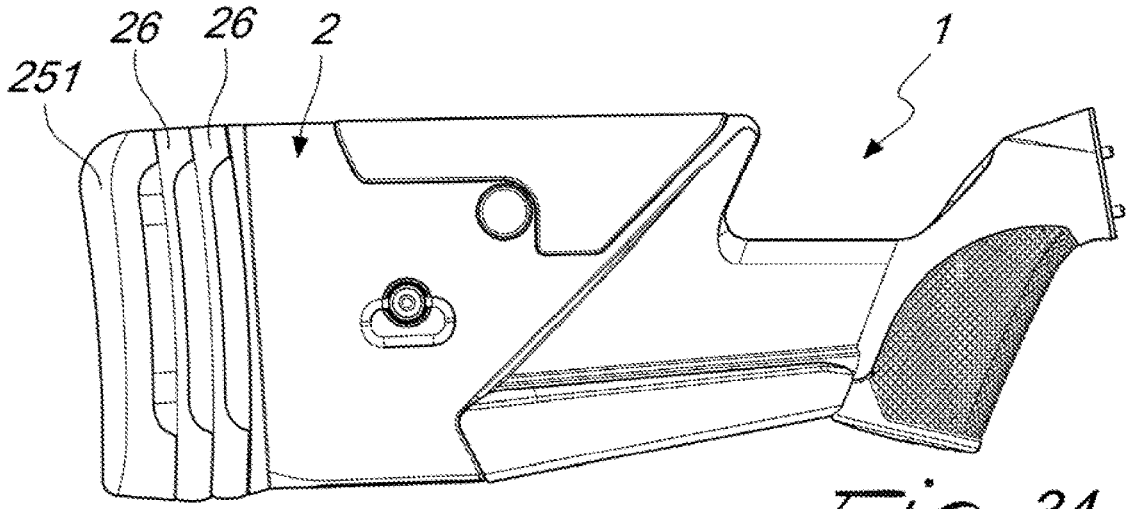
Figure 35:
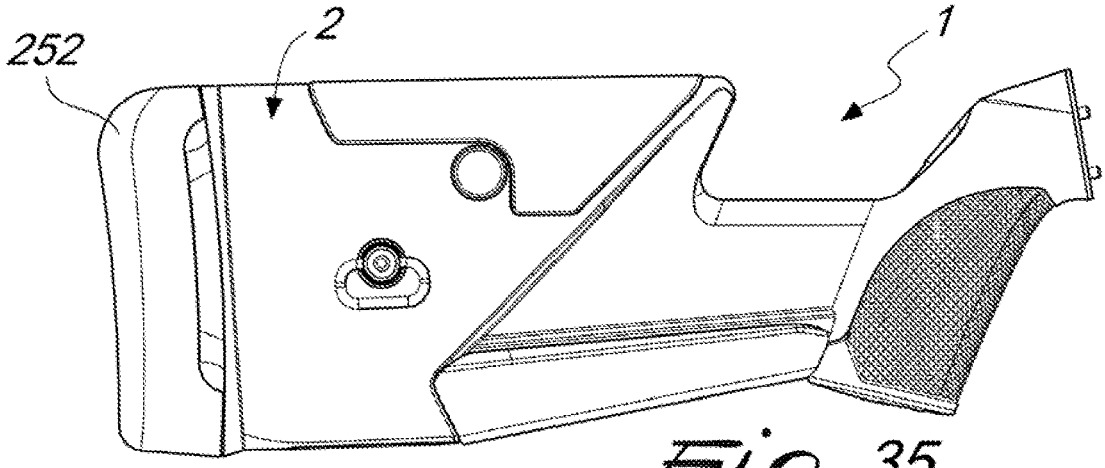
Figure 36:
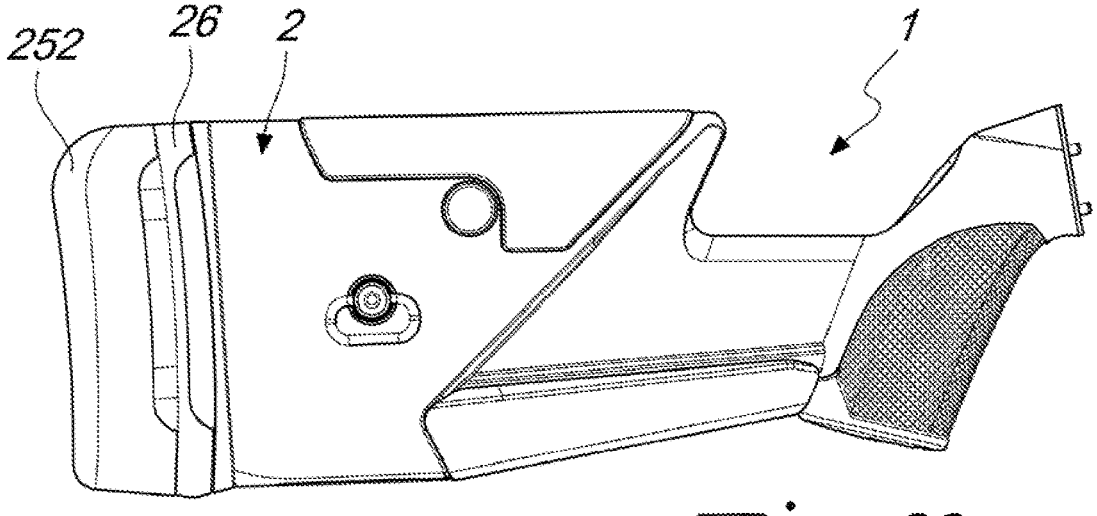
Figure 37:
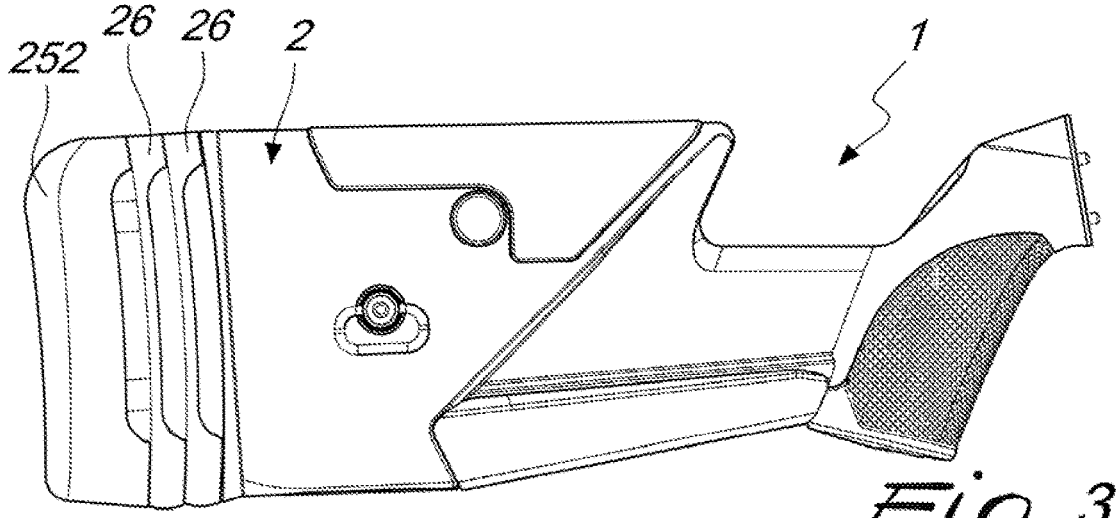
Figure 38:
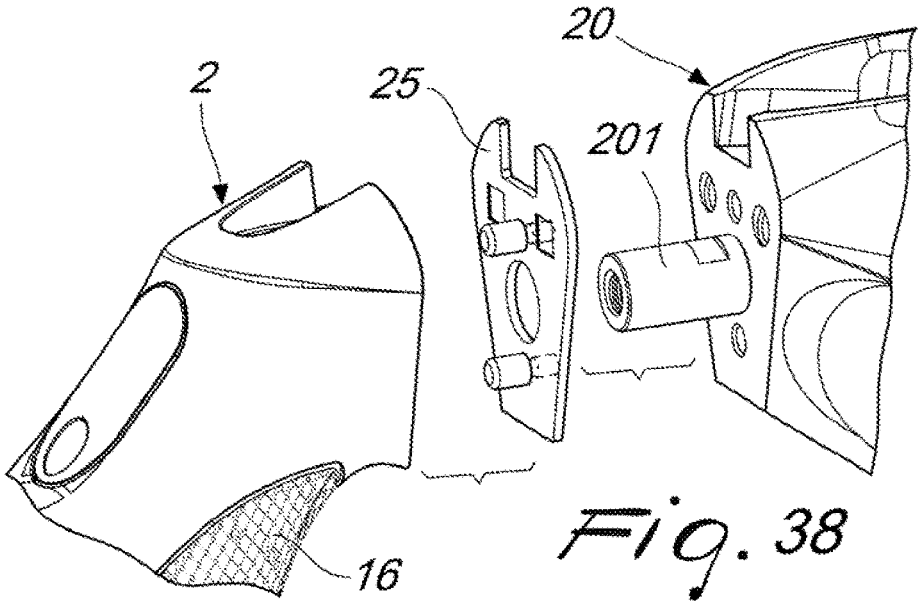
FIG. 38 is a partial exploded view illustrating an example of adjusting the trigger length of pull.

FIG. 29 shows an example of a buttplate 251 assembled without spacers.

Figure 30:
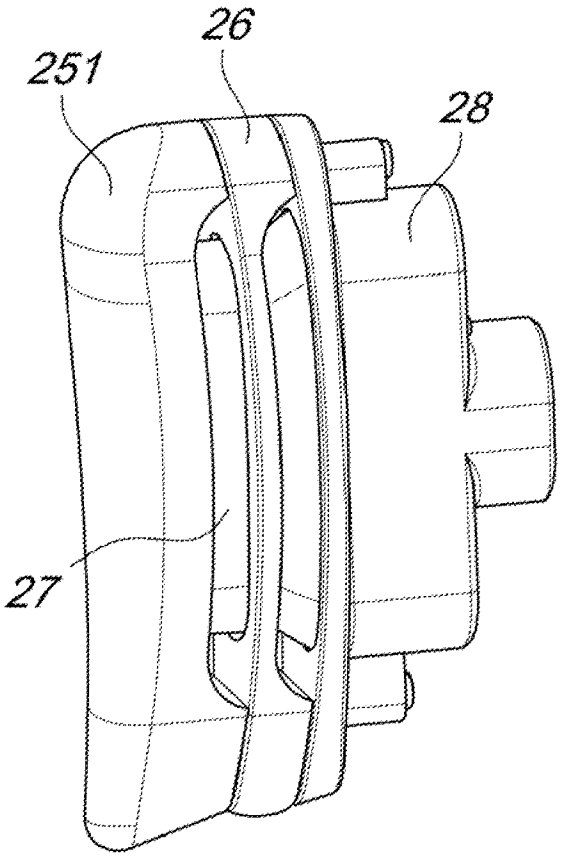
FIG. 30 is a perspective view of a comfort buttplate with a spacer kit.

FIG. 30 shows an example of a buttplate 251 assembled with a fixed spacer 26 and a movable spacer 27.

Figure 31:
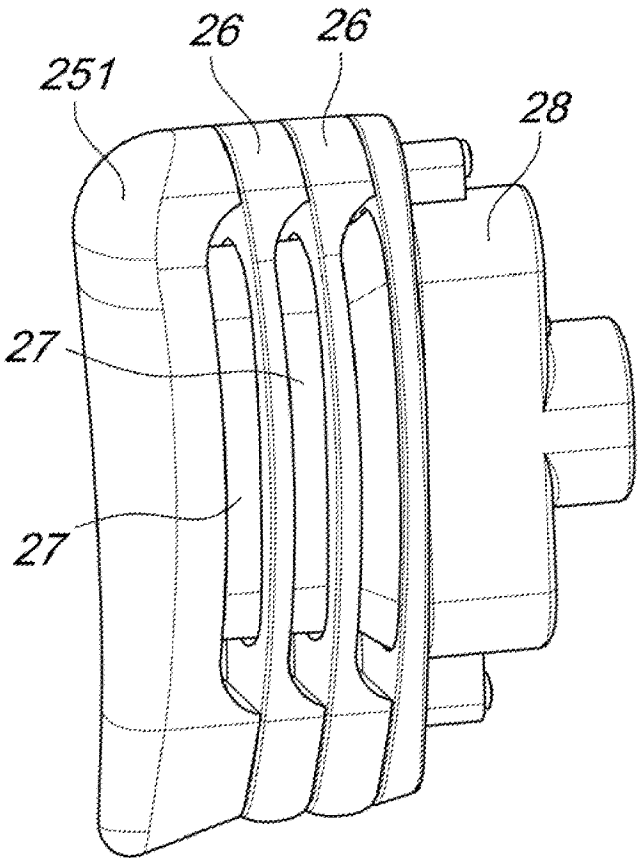
FIG. 31 is a perspective view of a comfort buttplate with two spacer kits.

FIG. 31 shows an example of a buttplate 251 assembled with two fixed spacers 26 and two respective movable spacers 27.

The spacers are assembled incorporated in the comfort recoil pad system (FIGS. 29-31) and there is no risk of losing them while using the shotgun.

The stock 1 further comprises a system for adjusting the trigger length of pull, i.e., the distance between the grip 16 and the trigger, of the type described in U.S. Ser. No. 11/035,644B2, in the name of this same applicant.

In particular, the position of the stock body 2 with respect to the body of the weapon 20, where the trigger is also located, is adjusted by means of the use of special plates 29.

Figure 39:
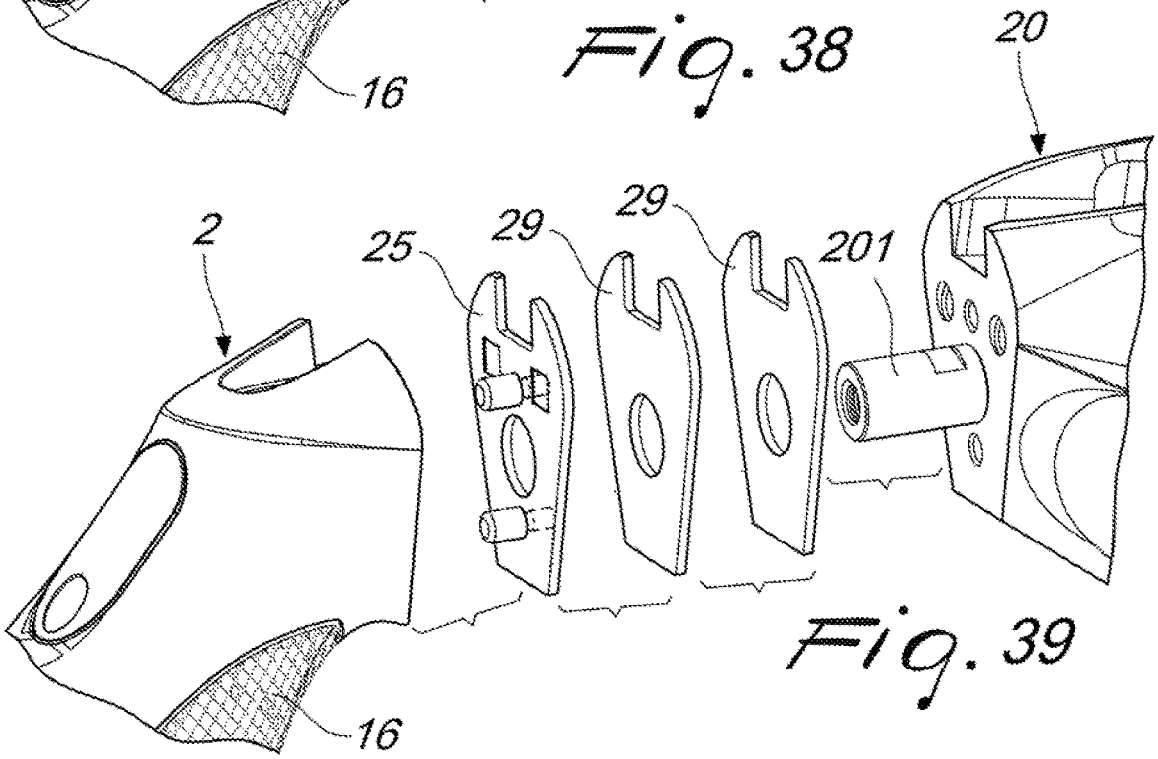
FIG. 39 is a partial exploded view illustrating a further example of adjusting the trigger length of pull.

Depending on the size of the user's hand, the user can choose the number and/or thickness of the plates 29 to be assembled, thereby adjusting the trigger length of pull, as visible in FIG. 39.

The stock 1 further comprises an M-Lok® slot, identified by the reference number 30.

The M-Lok® (Modular Lock) system comprises a rod which has a rectangular groove with rounded corners that act as a direct coupling point for compatible accessories.

The system allows the user to mount any M-Lok®-compatible accessory such as, for example, a monopod, used as a rear support.

Figure 40:
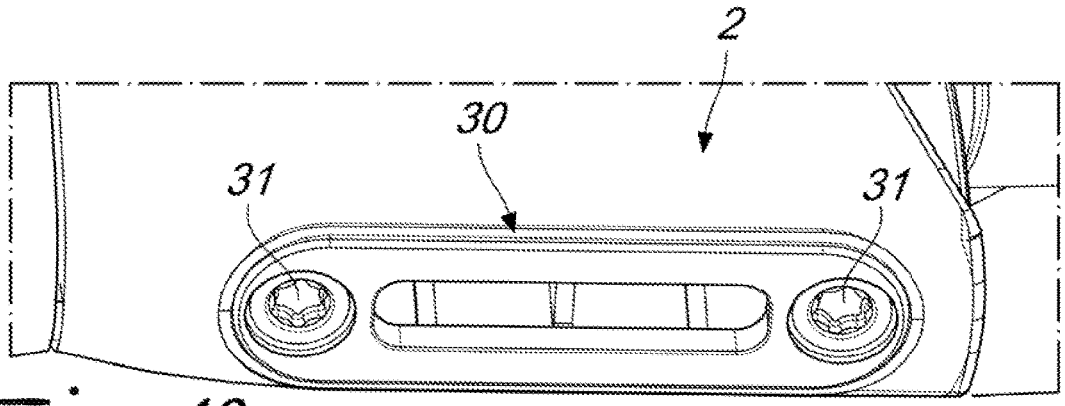
FIG. 40 is a partial view of the lower part of the stock illustrating an M-Lock insert.
Figure 41:
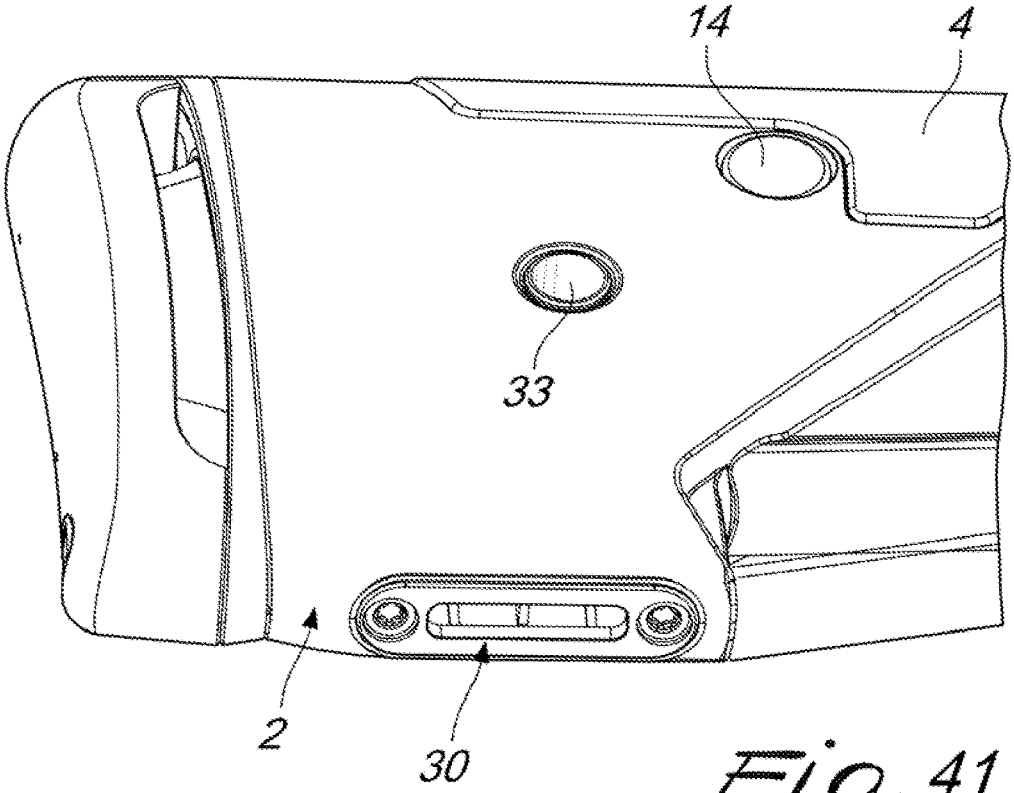
FIG. 41 is a partial side view of the stock, illustrating the metal insert for mounting accessories.
Figure 42:
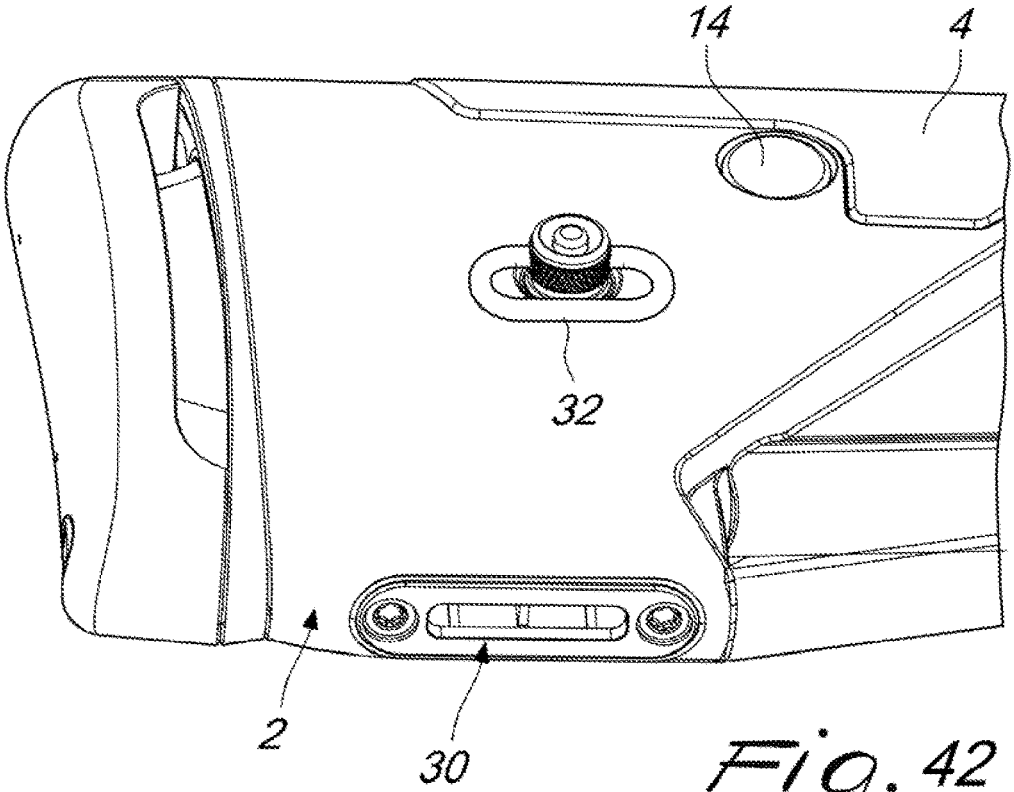
FIG. 42 is a partial side view of the stock, illustrating a quick release sling ring associated with the metal insert.

FIG. 40 illustrates the M-Lok® slot 30 fastened with two screws 31 to the stock body 2.

The stock 1 further comprises a quick fastener device which allows the user to fasten a quick release sling ring 32, for example; the quick release sling ring 32 interfaces with a metal insert 33 which is located on both sides of the stock body 2.

The position and profile of the inserts 33 allow both the assembly of any accessories and a 360-degree movement of the rotating part, without interfering with the user himself.

In practice, it has been found that the invention achieves the intended task and objects, by providing a gun stock with an adjustable comb having an adjustment mechanism integrated in the stock itself.

The system according to the present invention allows to make a stock with an adjustable comb with a lower industrial cost with respect to the products present on the market.

An advantage of the present invention is that the stock is designed to be highly modular, so as to meet the various needs of the users who can configure the weapon according to their shooting styles and preferences.

For example, the bag rider can be removed to expose the stock recess 19.

This application claims the priority of Italian Patent Application No. 102022000020964, filed on Oct. 11, 2022, the subject matter of which is incorporated herein by reference.

The invention claimed is:

1. A gun stock with adjustable comb comprising a stock body having an adjustable comb; said comb comprising a cheek rest member associated to a supporting structure associated to said stock body; said supporting structure comprising a hollow guide body slideable along a pin associated to said stock body; said guide body sliding with respect to said pin in contrast to an elastic member; said guide body being engaged by a drive means that comprises a button accessible from the outside of said stock body; a height of said comb with respect to said stock body being adjusted by acting on said button for engagement and disengagement of said guide body with respect to said pin associated to said stock body.

2. The gun stock, according to claim 1, wherein said elastic member comprises a drive spring coaxial to said pin.

3. The gun stock, according to claim 1, wherein said drive means comprises a set of teeth formed in said guide body and engaged by a stop pin by means of lugs.

4. The gun stock, according to claim 3, wherein said stop pin is hollow and comprises a limit member coaxial to a contrast spring.

5. The gun stock, according to claim 3, wherein said height of said comb is adjusted by pushing said stop pin button that disengages said teeth of said guide body, from a locking position to a free position, allowing said guide body to raise or lower to a desired position, in contrast with the action of said drive spring.

6. The gun stock, according to claim 1, comprising an interchangeable grip.

7. The gun stock, according to claim 1, comprising a detachable bag rider.

8. The gun stock, according to claim 1, comprising a system for fastening said stock body to a receiver of a gun; said fastening system comprising a screw passing through a recess formed in said stock body and covered by a lid; said lid being fastened to said stock body by means of a retaining screw accessible through a hole formed on a side opposite to said recess.

9. The gun stock, according to claim 1, comprising a system for the adjustment of the drop and cast, comprising an interchangeable plate inserted between said stock body and said receiver.

10. The gun stock, according to claim 1, comprising a length of pull adjusting assembly adjusting the distance between a buttplate of said stock and a trigger; said length of pull adjusting assembly comprising interchangeable buttplates having a different thickness and pairs of spacers each comprising a fixed spacer and a movable spacer that are adapted to cooperate with a recoil pad device.

11. The gun stock, according to claim 1, comprising a grip length of pull adjusting assembly adjusting a distance between a grip and a trigger of the gun.

12. The gun stock, according to claim 1, comprising a quick fastener device for accessory elements.

* * * * *